US012492459B2

(12) United States Patent
Chen et al.

(10) Patent No.: US 12,492,459 B2
(45) Date of Patent: Dec. 9, 2025

(54) PREPARATION METHOD FOR HETEROGENEOUS Mg ALLOYS BAR WITH HIGH ELASTIC MODULUS

(71) Applicant: Jiangsu University, Jiangsu (CN)

(72) Inventors: Xuefei Chen, Jiangsu (CN); Qile Huo, Jiangsu (CN); Zhen Peng, Jiangsu (CN); Rui Luo, Jiangsu (CN); Manping Liu, Jiangsu (CN)

(73) Assignee: Jiangsu University, Zhenjiang (CN)

( * ) Notice: Subject to any disclaimer, the term of this patent is extended or adjusted under 35 U.S.C. 154(b) by 265 days.

(21) Appl. No.: 18/327,073

(22) Filed: Jun. 1, 2023

(65) Prior Publication Data

US 2024/0360539 A1 Oct. 31, 2024

Related U.S. Application Data

(63) Continuation of application No. PCT/CN2023/091138, filed on Apr. 27, 2023.

(51) Int. Cl.

| | |
|---|---|
| ***C22F 1/06*** | (2006.01) |
| ***B22D 19/00*** | (2006.01) |
| ***B22D 19/16*** | (2006.01) |
| ***B22D 21/00*** | (2006.01) |
| ***C22F 1/02*** | (2006.01) |

(52) U.S. Cl.

CPC ..... *C22F 1/06* (2013.01); *B22D 19/00* (2013.01); *B22D 19/0081* (2013.01); *B22D 19/16* (2013.01); *B22D 21/007* (2013.01); *C22F 1/02* (2013.01)

(58) Field of Classification Search

CPC ..... C22F 1/06; B22D 19/0081; B22D 21/007

See application file for complete search history.

(56) References Cited

FOREIGN PATENT DOCUMENTS

| | | | | |
|---|---|---|---|---|
| CN | 109266947 A | * | 1/2019 | |
| CN | 110340330 A | * | 10/2019 | ..... B22D 19/0081 |
| CN | 112080675 A | * | 12/2020 | ..... B21C 1/003 |
| CN | 112981204 A | * | 6/2021 | ..... C22C 1/02 |
| KR | 2019138021 A | * | 12/2019 | ..... B22D 19/08 |

* cited by examiner

*Primary Examiner* — Keith Walker
*Assistant Examiner* — Jacky Yuen

(57) ABSTRACT

It provides a preparation method of solid-liquid composite casting in a specific mold to produce the heterostructured metallic bars composed of high elastic modulus metal and low elastic modulus Mg alloy. Subsequently, the microstructure of heterogeneous Mg alloys bars is adjusted by the specific deformation and heat treatment. Heterogeneous Mg alloys bars without oxide inclusions and with good interfacial bonding were prepared through this method. The improvement of elastic modulus is obtained by tailoring the heterogeneous microstructure.

5 Claims, 3 Drawing Sheets

PREPARATION METHOD FOR HETEROGENEOUS Mg ALLOYS BAR WITH HIGH ELASTIC MODULUS

TECHNICAL FIELD

The present invention belongs to the field of material preparation, in particular relates to a preparation method for heterogeneous Mg alloys bar with high elastic modulus. It provides a method of solid-liquid composite casting in a specific mold to produce the heterogeneous Mg alloys bars composed of high elastic modulus metal and low elastic modulus Mg alloy. The microstructures of the heterogeneous Mg alloys bars are adjusted by the subsequent deformation and heat treatment.

BACKGROUND TECHNOLOGY

Elastic modulus is one of the important mechanical properties of metallic materials. In engineering, elastic modulus is called material stiffness, which represents the resistance to elastic deformation. When the stiffness value is larger, the material will undertake smaller elastic deformation under the same stress. Actually, the stiffness of machine parts or components is expressed by the product of its cross-sectional area and the stiffness of the used materials. Therefore, metallic materials with high elastic modulus should be developed to improve the rigidity of machine parts without enlarging the cross-sectional area. It has been reported that the elastic modulus of metallic materials is a mechanical property index which is insensitive to the microstructure and external factors.

Mg alloy is the lightest structural material in current industrial applications. It has been widely used in the fields of national defense and military affairs, aerospace, automobile, electronic communication, etc. The wide use of advanced Mg alloys has great significance on realizing structural lightweight, energy conservation, and emission reduction. However, the elastic modulus of Mg alloys is lower as compared to the other light metals such as Al and Ti alloys, which highly restricts its further applications. It has been reported that strain rate, heat treatment and plastic deformation have limit effect on increasing the elastic modulus. Therefore, it is a challenge to produce Mg alloys with high elastic modulus.

Through literature reviews of existing techniques, it is found that the elastic modulus of Mg alloy is improved by adding alloy elements. Zhang et al. published "Effects of Si addition on microstructure and mechanical properties of Mg-8Gd-4Y-Nd Zr alloy" in Materials and Design, 2013, 43, 74-79. In this work, the second phase particles with high elastic modulus were introduced by alloying method. Additional Si (1.0 wt. %) was added into Mg-8Gd-4Y-1Nd-1Zr alloy to increase the elastic modulus from 44 GPa to 51 GPa. The increase of elastic modulus was attributed to the formation of sufficient particles with high modulus in the matrix. However, with the increase of Si content, the fluidity of the alloy melt decreases significantly, which is not conducive to the preparation of higher elastic modulus alloys. In addition, Hu et al. published "Microstructures and mechanical properties of the Mg-8Gd-4Y-Nd—Zn-3Si (wt %) alloy" in Materials Science and Engineering: A, 2013, 571, 19-24. In that work, a little content Zn was added in Mg-8Gd-4Y-Nd-3Si alloy, which improves the fluidity of alloy melt. Through the research of alloying, the elastic modulus was improved by adding a certain amount of alloy elements or rare earth elements due to the formation of reinforced particles with high elastic modulus. Nevertheless, the strength of the alloys has decreased because of the elemental additions. Moreover, the plasticity of Mg alloys becomes worse.

Furthermore, it is another common method to improve the elastic modulus by adding reinforcements to the Mg alloy matrix to prepare composites. Compared with the alloying method, the elastic modulus of Mg matrix was significantly improved by introducing particle reinforced phase, whisker reinforced phase, fiber reinforced phase and carbon nanotubes. Liu et al. published "Interfacial Microstructure and Mechanical Properties of Aluminum Silicate Short Fiber Reinforced AZ91D Composites" in Acta Matericae Compositae Sinica, 2008, 6, 156-159. A (Al2O3-SiO2)/AZ91D Mg matrix composite was prepared by Extrusion infiltration process. The elastic modulus increased about 58%, from 38.5 GPa to 61 GPa. Thus, the composite method can effectively improve the strength and elastic modulus, but the plasticity is sharply reduced. Moreover, the price of high-modulus reinforcement phase is expensive, and the treatment process is relatively complex, which is not conducive to industrial applications.

SUMMARY OF THE INVENTION

Technical Problem

The present invention has been made to provide a preparation method for heterogeneous Mg alloys bar with high elastic modulus.

In order to realize the improvement of elastic modulus, the present invention It provides a method of solid-liquid composite casting in a specific mold to produce the heterogeneous Mg alloys bars composed of high elastic modulus metal and low elastic modulus Mg alloy. The microstructures of the heterogeneous Mg alloys bars are adjusted by the subsequent deformation and heat treatment.

Technical Solution

According to the present invention, the preparation method for heterogeneous Mg alloys bar with high elastic modulus includes the following four steps.

Firstly, the pretreatment is as follows. Select two metals with large difference in elastic modulus. The metal with high elastic modulus is cast in solid form, and its shape is spiral spring or disc spring. The solid metal surface is chemically cleaned to remove the oil stain and oxide. Then the cleaned surface is galvanized using plating, hot dip plating, thermal spraying, vapor deposition, etc. A zinc coating with a proper thickness of 0.1~50 μm can be obtained after galvanizing. If the zinc layer is too thin, it will be vaporized before casting and cannot prevent surface oxidization. If the thickness is too thick, the zinc layer will completely dissolve into the middle area of the casting materials, which leads to the failure to form metallurgical bonding. Moreover, zinc will segregate at the metallurgical bonding interface, which will affect the performance of the heterogeneous Mg alloys. Zinc, being an abundant and low-cost metal, possesses desirable physical properties such as low melting point, high thermal conductivity, and exceptional corrosion resistance. Therefore, it is an excellent candidate to act as an intermediate layer metal for solid-liquid composite casting of Magnesium alloys. Place the pretreated solid metal in the mold cavity, and then wrap the mold with a heating sleeve to preheat the solid metal and mold. The preheating temperature is 500~800° C., most preferably 650~670° C. And the time is 1~10 hours, more preferably 2-8 hours, most preferably 5-7 hours. The diameter of the high elastic modulus metal is preferably 1-99% of the die cavity diameter, more preferably 10-80%, and most preferably 30-50%. The diameter of the die cavity is preferably 10-100 cm, more preferably 20-80 cm, and most preferably 30-50 cm.

Secondly, the solid-liquid composite casting is as follows. The outer heating sleeve is removed and casting is performed under antioxygen and inert gas atmosphere. The casting temperature is 650~1000° C., more preferably 700~900° C., and most preferably 750~800° C. After casting, the heating sleeve is wrapped to keep the temperature at 500~800° C., more preferably 550~750° C., and most preferably 600~700° C. The heating time is 2-8 hours, more preferably 3-5 h. A perfect metallurgical combination of the solid-liquid interface can be formed.

Thirdly, the deformation process is as follows. The heterogeneous Mg alloys bar is deformed by extrusion, drawing or rotary forging at the temperature range of 100° C.~500° C., more preferably 200~400° C., and most preferably 250~300° C. The plastic deformation can eliminate defects in casting, and improve the interfacial bonding.

Finally, the heat treatment is as follows. The deformed heterogeneous metallic bar is treated by vacuum solution to eliminate the influence of deformation and tune the microstructure. The solution temperature is determined by the low elastic modulus metal, more preferably 500~800° C., with the solution time of 1~12 hours.

Advantageous Effects

Compared with the reported techniques, the present invention has the following advantages. Firstly, the present invention adopts the method of solid-liquid composite casting molding on double alloys or multi alloys, which has great directivity and flexibility in microstructure design. The type, proportion, distribution of the constituent zones can be tailored with flexibility. Thus, the present invention can satisfy the requirement of preparing a series of metallic bars with high elastic modulus. Secondly, the present invention can prepare large-sized bars by simple process and easy operation, which can meet the needs of industrial applications. Thirdly, perfect interface bonding without oxidation inclusions can be obtained by solid-liquid composite casting, resulting in the good mechanical properties.

DESCRIPTION OF ATTACHED DRAWINGS

Embodiments of the invention will now be described, by way of example only, with reference to the accompanying drawings, in which.

SPECIFIC EMBODIMENTS

Reference will now be made in detail to various embodiments of present invention with reference to the accompanying drawings. In the following description of the present invention, detailed descriptions of well-known technologies will be omitted. However, the following embodiments will enable a person having ordinary skill in the art to easily understand the characteristic constitutions and effects of the present invention and put the present invention into practice with no significant difficulties.

Embodiment 1

Embodiment 1 selected a VCoNi medium-entropy alloy as the solid metal and AZ31 as liquid metal. According to embodiment 1, the preparation method for heterogeneous Mg alloys bar with high elastic modulus includes the following four steps.

Figure 1:
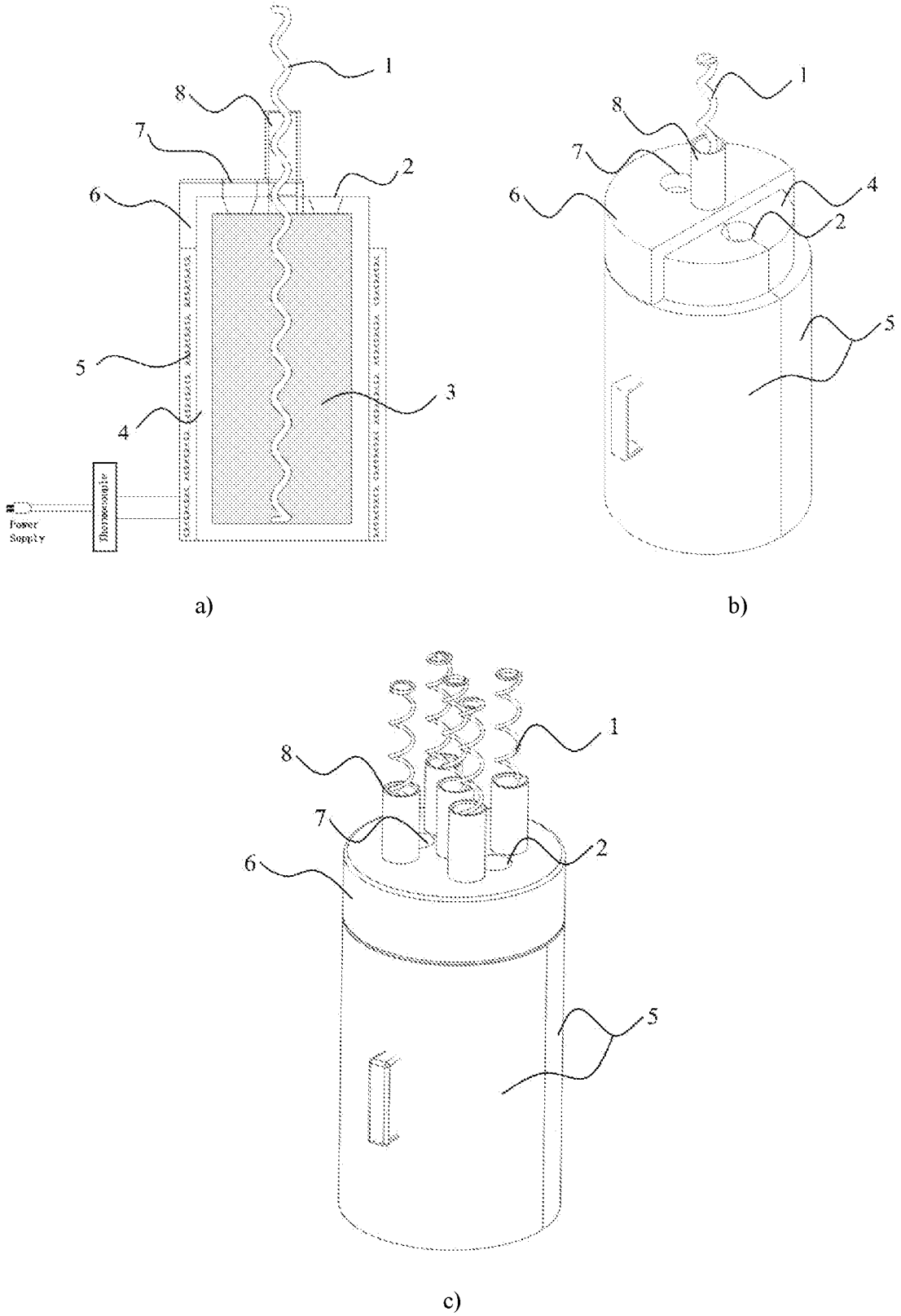
FIG. 1 is sketch map of pretreatment.

Firstly, as shown in FIG. 1*a*, the shape of solid metal is designed as heliciform. The surface of helical VCoNi alloy 1 is chemically cleaned to remove the oil stain and oxide. A zinc layer with a thickness of 30 μm is galvanized on the surface of VCoNi alloy. The pre-treated helical VCoNi alloy 1 is placed through the positioning hole 8 of the positioning die 6 and fix in the cavity of the die 4. Then, a heating sleeve 5 is wrapped around the mold to preheat the helical VCoNi alloy 1 and mold at 800° C. for 2 hours.

Secondly, as shown in FIG. 1*b*, the heating sleeve 5 is removed. Casting is then performed under the antioxygen and inert gas shielding atmosphere. Pouring is carried out at 800° C. with Liquid AZ31 alloy poured from gate 7 and overflowed from riser 2. After pouring, the heating sleeve 5 is quickly wrapped for heat preservation. The temperature is hold at 500° C. for 2 hours to help form a metallurgical bonding of the solid-liquid interface.

Figure 2:
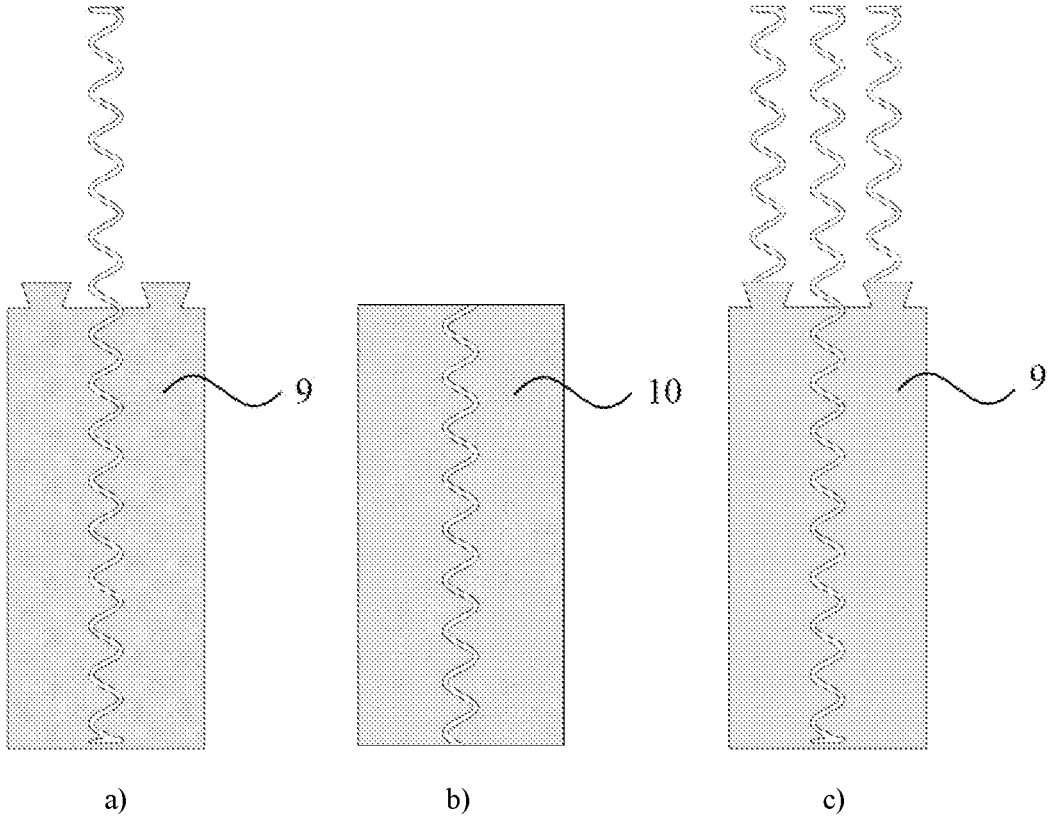
FIG. 2 is sketch map of solid-liquid composite casting.
Figure 3:
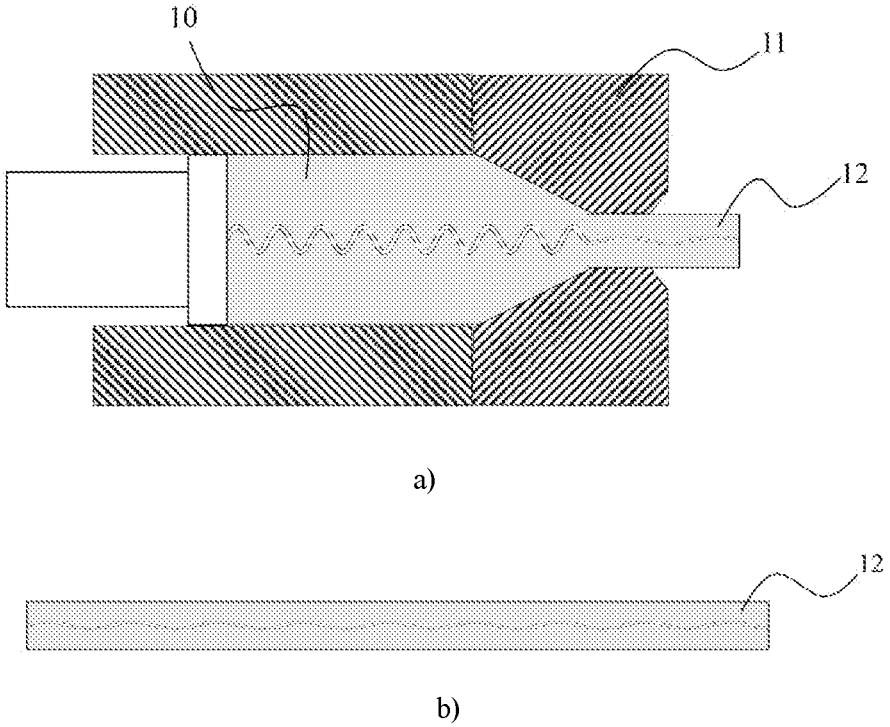
FIG. 3 is sketch map of cast ingot and deformation.

Thirdly, as shown in FIG. 2*a*, the cast ingot 9 with the diameter of 15 cm and the length of 50 cm is produced. The bar 10 with a diameter of 15 cm is cut from the cast ingot 9, as shown in FIG. 2*b*. FIG. 3*a* shows that the bar 10 is extruded along the axial direction by the extruder 11. The extrusion temperature is 200° C., and the extrusion ratio is 1:2. After multiple passes of extrusion, the extruded bar 12 with a diameter of 1 cm is obtained, as shown in FIG. 3*b*.

Figure 4:
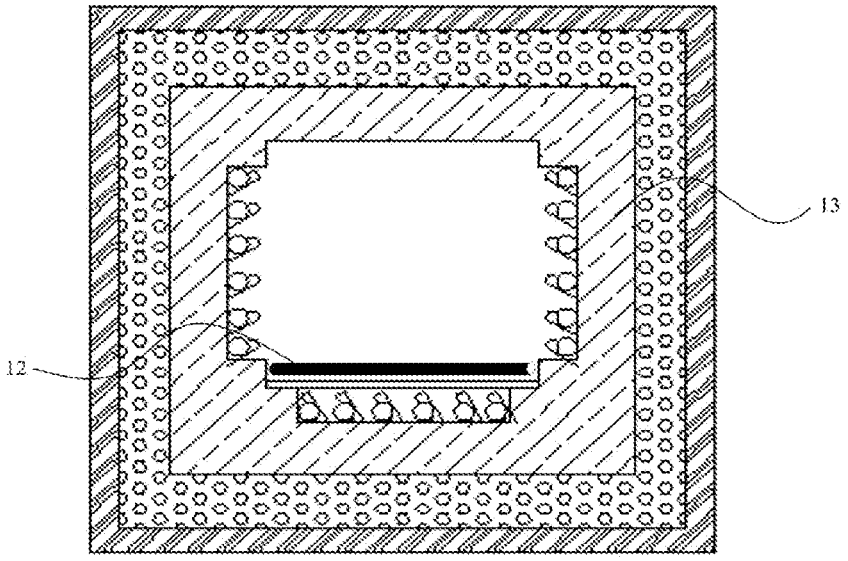
FIG. 4 is sketch map of heat treatment.
Figure 5:
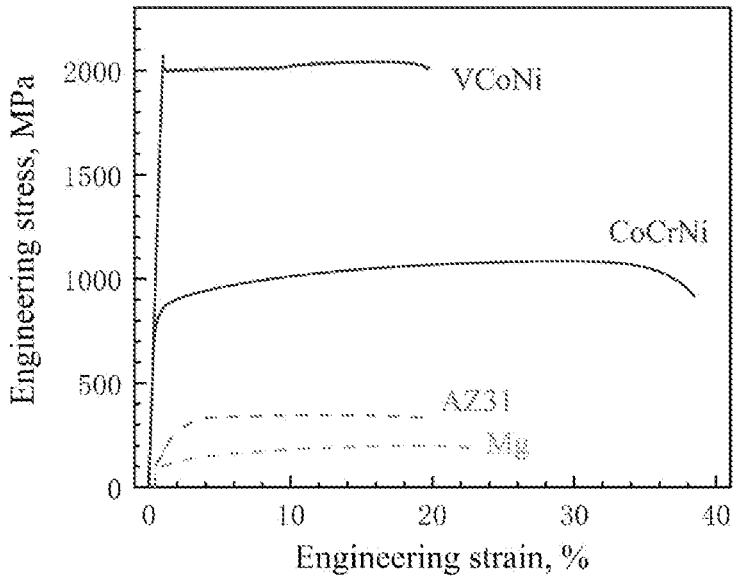
FIG. 5 is curves of mechanical properties.

Finally, as shown in FIG. 4, the extruded bar 12 is subjected to solution treatment at 500° C. for 12 hours in a high-temperature vacuum furnace 13 under argon atmosphere. Heat treatment can eliminate the influence of deformation and regulate the microstructure of heterogeneous metal. FIG. 5 shows the tensile engineering mechanical properties of VCoNi (blue curve) and AZ31 (green dash curve). The elastic modulus of AZ31 is 13 GPa. While the elastic modulus of VCoNi is nearly 16 times of that of AZ31, about 207 GPa. Furthermore, AZ31 exhibits a uniform elongation of approximately 19%, while VCoNi has a similar uniform elongation of close to 20%. This similarity in plasticity between the two materials is advantageous in preserving the overall plasticity of heterogeneous bars. The embodiment 1 successfully produces Mg alloy bars with high elastic modulus through the solid-liquid cast, deformation and heat treatment.

Embodiment 2

Embodiment 2 selected a CoCrNi medium-entropy alloy as the solid metal and AZ31 as liquid metal. According to embodiment 2, the preparation method for heterogeneous Mg alloys bar with high elastic modulus includes the following four steps.

Firstly, as shown in FIG. 1*c*, the shapes of solid metal are designed as heliciform. The surfaces of multiple helical CoCrNi alloys 1 are chemically cleaned to remove the oil stain and oxide. A zinc layer with a thickness of 30 μm is galvanized on the surfaces of CoCrNi alloys. The pre-treated helical CoCrNi alloys 1 are placed through the positioning holes 8 of the positioning die 6 and preset in the cavity of the die 4. Then, a heating sleeve 5 is wrapped around the mold to preheat the helical CoCrNi alloys 1 and the total mold at 800° C. for 2 hours.

Secondly, as shown in FIG. 1*c*, the heating sleeve 5 is removed. Casting is then performed under the antioxygen and inert gas shielding atmosphere. Pouring is carried out at 800° C. with Liquid AZ31 alloy poured from gate 7 and overflowed from riser 2. After pouring, the heating sleeve 5 is quickly wrapped for heat preservation. The temperature is hold at 500° C. for 2 hours to help form a metallurgical bonding of the solid-liquid interfaces.

Thirdly, as shown in FIG. 2*c*, the cast ingot 9 with the diameter of 30 cm and the length of 50 cm is produced. The bar 10 with a diameter of 30 cm is cut from the cast ingot 9, as shown in FIG. 2*b*. FIG. 3*a* shows that the bar 10 is extruded along the axial direction by the extruder 11. The extrusion temperature is 200° C., and the extrusion ratio is 1:2. After multiple passes of extrusion, the extruded bar 12 with a diameter of 2 cm is obtained, as shown in FIG. 3*b*.

Finally, as shown in FIG. 4, the extruded bar 12 is subjected to solution treatment at 500° C. for 12 hours in a high-temperature vacuum furnace 13 under argon atmosphere. Heat treatment can eliminate the influence of deformation and regulate the microstructure of heterogeneous metal. FIG. 5 shows the tensile engineering mechanical properties of CoCrNi (brown curve) and AZ31 (green dash curve). The elastic modulus of AZ31 is 13 GPa. While the elastic modulus of CoCrNi is nearly 16 times of that of AZ31, about 206 GPa. Furthermore, AZ31 displays a uniform elongation of approximately 19%, while CrCoNi exhibits a uniform elongation exceeding 30%. This superior plasticity of CrCoNi compared to low elastic modulus alloys is advantageous in preserving the overall plasticity of heterogeneous bars. The embodiment 2 successfully produces Mg alloy bars with high elastic modulus through the solid-liquid cast, deformation and heat treatment.

Embodiment 3

Embodiment 3 selected a VCoNi medium-entropy alloy as the solid metal and pure Mg as liquid metal. According to embodiment 3, the preparation method for heterogeneous Mg alloys bar with high elastic modulus includes the following four steps.

Firstly, as shown in FIG. 1*a*, the shape of solid metal is designed as heliciform. The surface of helical VCoNi alloy 1 is chemically cleaned to remove the oil stain and oxide. A zinc layer with a thickness of 30 μm is galvanized on the surface of VCoNi alloy. The pre-treated helical VCoNi alloy 1 is placed through the positioning hole 8 of the positioning die 6 and preset in the cavity of the die 4. Then, a heating sleeve 5 is wrapped around the mold to preheat the helical VCoNi alloy 1 and the total mold at 800° C. for 2 hours.

Secondly, as shown in FIG. 1*b*, the heating sleeve 5 is removed. Casting is then performed under the antioxygen and inert gas shielding atmosphere. Pouring is carried out at 800° C. with Liquid pure Mg poured from gate 7 and overflowed from riser 2. After pouring, the heating sleeve 5 is quickly wrapped for heat preservation. The temperature is hold at 500° C. for 2 hours to help form a metallurgical bonding of the solid-liquid interface.

Thirdly, as shown in FIG. 2*a*, the cast ingot 9 with a diameter of 15 cm and length of 50 cm is produced. The bar 10 with a diameter of 15 cm is cut from the cast ingot 9, as FIG. 2*b* shown. As shown in FIG. 3*a*, the bar 10 is extruded along the axial direction by the extruder 11. The extrusion temperature is 200° C., and the extrusion ratio is 1:2. After multiple passes of extrusion, the extruded bar 12 with a diameter of 1 cm is obtained, as shown in FIG. 3*b*.

Finally, as shown in FIG. 4, the extruded bar 12 is subjected to solution treatment at 500° C. for 12 hours in a high-temperature vacuum furnace 13 under argon atmosphere. Heat treatment can eliminate the influence of deformation and regulate the microstructure of heterogeneous metal. FIG. 5 shows the tensile engineering mechanical properties of VCoNi (blue curve) and pure Mg (orange dash curve). The elastic modulus of pure Mg is 45 GPa. While the elastic modulus of VCoNi is nearly 5 times of that of pure Mg, about 207 GPa. Furthermore, Mg exhibits a uniform elongation of approximately 20%, while VCoNi has a similar uniform elongation of close to 20%. This similarity in plasticity between the two materials is advantageous in preserving the overall plasticity of heterogeneous bars. The embodiment 3 successfully produces Mg alloy bars with high elastic modulus through the solid-liquid cast, deformation and heat treatment.

What is claimed is:

1. A method for preparing heterogeneous Mg alloys bar, which is involved in the following steps:

Step 1: pretreating a high elastic modulus metal, which comprises chemically cleaning surfaces of the high elastic modulus metal to remove oil stain and oxide, performing galvanizing treatment on the surfaces of the high elastic modulus metal to obtain a pre-treated solid metal that has a zinc layer with a proper thickness, presetting the pre-treated solid metal in a cavity of a mold, and then, wrapping a heating sleeve around the mold to preheat the pre-treated solid metal and the mold; wherein an elastic modulus of the high elastic modulus metal is at least four times that of Mg, and the high elastic modulus metal is selected from one of high entropy alloys CoCrNi and VCoNi and is solid state;

Step 2: performing solid-liquid composite casting operation on the pre-treated solid metal, which comprises under an antioxygen and inert gas shielding atmosphere, removing the heating sleeve, and then performing casting operation on the pre-treated solid metal to obtain a heterogeneous Mg alloy cast ingot, wherein the casting operation comprises pouring liquid Mg or liquid Mg alloy into the mold, and wrapping the heating sleeve around the mold to perform heat preservation on the mold;

Step 3: deforming the heterogeneous Mg alloy cast ingot, which comprises cutting the heterogeneous Mg alloy cast ingot to obtain heterogeneous metal bar, and extruding, drawing or rotary forging the heterogeneous metal bar to obtain a deformed heterogeneous metal bar, thereby to eliminate casting defects and improve an interfacial bonding quality; and Step 4: performing heat treatment on the deformed heterogeneous metal bar, which comprises performing vacuum solution on the deformed heterogeneous metal bar to obtain a heterogeneous Mg alloy bar, thereby to eliminate an influence of deformation and tailor a microstructure of heterogeneous metal;

wherein: in step 1, the heating sleeve is wrapped around the mold to perform preheating treatment to hold temperature at 650~670° C., which is not lower than a melting point temperature of Mg or Mg alloy, for 5-7 hours; in step 2, after pouring, the heating sleeve is quickly wrapped for heat preservation, heat preservation temperature is held at 600~700° C. for 2~8 hours; and in step 3, the heterogeneous metal bar is deformed by extrusion, drawing or rotary forging at a deformation temperature of 250~300° C.

2. The method of claim 1, wherein in step 1: a shape of the pre-treated solid metal is coil or disc spring, a quantity of solid metal is placed according to specific actual needs, ranging from 1 to 100, a diameter of the pre-treated solid metal accounts for 1% ~99% of a diameter of the mold cavity, and the diameter of the mold cavity ranges from 10~100 cm.

3. The method of claim 1, wherein in step 1: galvanizing treatment adopts electroplating, hot dip plating, thermal spraying, or vapor deposition, a thickness of the zinc layer is 0.1~50 μm, and the pre-treated solid metal is passed through a positioning hole of the mold and preset in the mold cavity.

4. The method of claim 1, wherein in step 2: pouring temperature of pouring liquid Mg or liquid Mg alloy is 650~1000° C.

5. The method of claim 1, wherein in step 4: the deformed heterogeneous metal bar is treated by vacuum solution to eliminate the influence of deformation and regulate the microstructure of heterogeneous metal, heat treatment temperature is determined by Mg or Mg alloy, and the range is 400~900° C., with the time of 1~12 hours.

* * * * *